United States Patent [19]

Lee

[11] Patent Number: 4,836,078

[45] Date of Patent: Jun. 6, 1989

[54] MULTIFUNCTIONAL AMMUNITION CASE RELOADING DIE

[76] Inventor: Richard J. Lee, 3146 Kettle Morraine Rd., Hartford, Wis. 53027

[21] Appl. No.: 252,660

[22] Filed: Oct. 3, 1988

[51] Int. Cl.[4] ..... F42B 33/02; F42B 33/10; F42B 33/12; F42B 11/02

[52] U.S. Cl. ..... 86/24; 86/23; 86/28; 86/36; 86/37; 86/39; 86/40; 86/43

[58] Field of Search ..... 86/23, 24, 28, 36, 37, 86/38, 39, 40, 43; 29/1.31; 72/367, 370, 352, 356

[56] References Cited

U.S. PATENT DOCUMENTS

| | | | |
|---|---|---|---|
| 3,049,044 | 8/1962 | English | 86/24 |
| 3,134,293 | 5/1964 | Lee | 86/24 |
| 3,175,456 | 3/1965 | Goodsell | 86/23 |
| 3,745,875 | 7/1973 | Kennedy | 86/23 |
| 4,336,739 | 6/1982 | Alexander | 86/23 |
| 4,385,546 | 5/1983 | Lee | 86/36 |
| 4,515,063 | 5/1985 | Lee | 86/27 |
| 4,522,102 | 6/1985 | Pickens | 86/27 |
| 4,566,366 | 1/1986 | Lee | 86/24 |
| 4,593,598 | 6/1986 | Gunder | 86/36 |
| 4,637,291 | 1/1987 | Alexander | 86/23 |

*Primary Examiner*—Howard J. Locker

*Attorney, Agent, or Firm*—Fuller, Puerner & Hohenfeldt

[57] ABSTRACT

An ammunition reloading die having a generally cylindrical axially bored body and an external thread for mounting it in a reloading press. In one embodiment, a case sizer element is threaded onto and is removable from the nominally lower end of the die body into which cases are pressed for sizing the outer diameter. A stepped mandrel is insertable in the die body. It has a decapping pin extending from its nominally lower end. A bullet seating plug is screwed into the upper end of a body's bore for backing up the mandrel when a case is being pressed onto the mandrel to expand and flare the mouth end of the case and to expel the spent primer from the case. A new primer is installed and the case is charged with powder and a bullet is set in the mouth after which the case is pressed into the die body while the mandrel is removed but the bullet seating plug is installed in the die body in which case pressing the case into the die body seats the bullet and crimps the case in the bullet.

10 Claims, 4 Drawing Sheets

50
55
53
32
30
52
14
59B
38B
12
39B
40B
18
17
51

30
31
94
90
34B
93
62
63
92
91

59
38
61
42

33
30A
63A
81
80
34A

MULTIFUNCTIONAL AMMUNITION CASE RELOADING DIE

BACKGROUND OF THE INVENTION

The invention disclosed herein is a die which is installed in an ammunition case reloading press for performing case reloading operations that have been traditionally performed by using three individual dies. An important feature of the new die is that for reloading a plurality of ammunition cases of the same size, the die body is screwed into the reloading press and remains there until all of the reloading operations such as decapping and sizing the cases and pressing bullets into the cases are performed. Another important feature is that the sizer element for resizing the outside of the ammunition cases is separable from the die body.

The conventional case reloading process involves a sequence of steps which are usually performed by manual operation of a reloading press. Reloading presses are equipped with a head into which one die can be screwed or with a turret into which up to three dies, usually, can be screwed. If only one die can be mounted to the press, it will usually have to be removed and replaced with a second die and then a third die to complete all of the steps involved in reloading ammunition cases. Typically, a press has a manually operable lever which, through a linkage system, drives a ram toward and away from one of the dies at a time. The ram has a case holder at its end facing the die or dies so that the case can be pushed into a die and retracted from the die.

Typically, the first die used in a series of reloading operations comprises a generally cylindrical externally threaded body in which there is a central bore terminating at its lower end with a case sizing bore of reduced diameter which is substantially equal to the desired outside diameter of the case. This die customarily has a decapping pin coaxial with the bore. The first operation of the ram forces the case through the reduced diameter bore to resize the outside diameter of the case. At the same time, the decapping pin extends through the flash hole leading to the primer pocket in the case head so as to drive the spent primer or cap out of the pocket.

The second step is to expand or flare the bullet receiving mouth of the case. This, in conventional practice, involves using another die which may be in a turret next to the first one used or it may have to be screwed into the head of the press as a replacement for the first die. The second die contains a plug at whose bottom end there is a reduced diameter portion and a slightly increased diameter portion. The case is forced over the reduced diameter portion for sizing the inside diameter of the neck of the case and the larger diameter portion causes the case to flare out slightly at its mouth to shape it for easy entry of a bullet.

After a batch of spent cartridges are sized on their outsides and after their necks are expanded and mouths are flared with the two different dies described above, each of the cases has a new primer or cap inserted into it by using a cap or primer inserter that is mounted on the press itself or is independent of the press. After all of the cases are primed, they are charged with powder in an amount commensurate with the caliber of the case.

The next and final step, in conventional practice, is to screw a bullet seating die in the press or, if there is a turret for more than one die, to rotate the turret until the third die used for bullet seating is aligned with the ram of the press. Then, the cases which have been charged with powder and in which a bullet has been manually set, are placed successively on the case holder of the ram and driven into the third die which seats the bullet into the case and at the same time usually crimps the mouth inwardly to seize the bullet.

It should be evident that it would be highly desirable if a single die body could be screwed into the head or turret of a press and could remain there for sizing the outside diameter of the cases, sizing the neck end and flaring the mouth of the cases, decapping the cases and pressing the bullet into the cases and crimping the cases to securely grip the bullets when the bullets are at the proper depth in the case. The invention disclosed herein provides for performing all of these steps with a die body that is screwed into the press only once for a particular batch of cases that are to be reloaded and stays there until reloading of the batch is completed. Provision is also made for securing the ammunition case outside diameter resizing element coaxially with the die body and for removing this element from coaxial relationship to the die body for enabling performance of several other case conditioning operations with the die.

An approach to reducing the number of dies necessary to perform a case reloading sequence is illustrated in U.S. Pat. No. 4,637,291. This patent teaches using one die to size the outside diameter of the cases and to decap them and to use a second die for performing some of the functions discussed above. The second die, however, is not simply turned into the head or turret of a reloading press and allowed to stay there for all operations that are to be performed on the cases of a particular size that are to be reloaded. Instead, some of the operations are performed when the second die is screwed into the press in one orientation and other operations are performed after the die has been unscrewed and inverted and rescrewed into the press. A disadvantage of this is that the die has to be readjusted relative to the press ram and the case carried thereon so that overstressing or undersizing a case does not take place.

SUMMARY OF THE INVENTION

An objective of the present invention is to expedite the ammunition case reloading process by providing a multifunctional die having a body that can be screwed into the head or turret of a reloading press and be established at an adjusted position relative to the cartridge holder on the ram of the press such that the body of the die will be simultaneously placed in the exact position of adjustment which is required for the last operation performed on the ammunition case, that is, the pressing and crimping of the bullet in the case.

Another important feature is to provide for threadingly coupling the case outside resizing element directly to the die body and coaxial to the body, or, alternatively, provide for screwing the resizing element directly into the die supporting head of a reloading press such that the resizing element can abut and be coaxial with the die body and can be easily separated from the body after resizing a batch of cases is complete so that other operations can be performed on the cases without affecting their size.

Another important feature of the new die is that it minimizes the number of parts that must be provided and machined which means that the single die assembly can be sold for much less than the two additional dies which it replaces.

How the foregoing and other features of the invention are achieved will be evident in the more detailed description of a preferred embodiment of the invention which will now be set forth in reference to the drawings.

DESCRIPTION OF A PREFERRED EMBODIMENT

Figure 1:
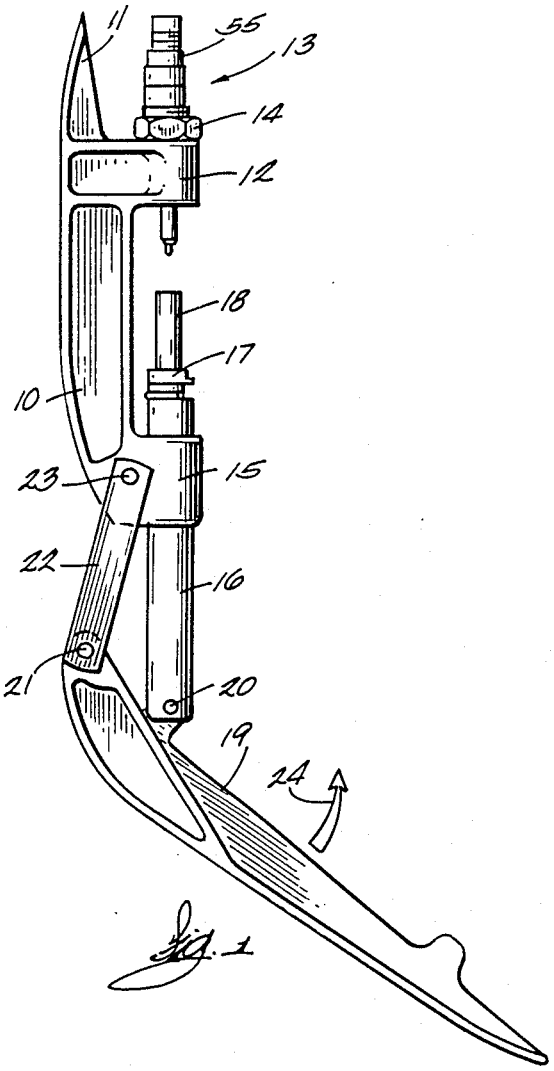
FIG. 1 is a side elevational view of a manually held and operated reloading press in which the new multifunctional die can be used.

FIG. 1 illustrates a hand held reloading press in which the new multifunctional ammunition case reloading die can be used. The press is illustrated in greater detail in U.S. Pat. No. 4,566,366 which is owned by the owner of the present invention. The new die can be used in a variety of commercially available presses. The press in FIG. 1 comprises a body 10 from which a handle portion 11 extends. A head 12 extends laterally and integrally from body 10. The head has one of the new multifunctional ammunition case reloading dies, which is generally designated by the numeral 13, screwed into it wherein it is held in a locked position by a lock nut 14. A boss 15 extends laterally and integrally from press body 10. A cylindrical ram 16 is reciprocable through boss 15. An ammunition case holder 17 is mounted to the upper end of the ram. Presently, a case marked 18 is held in the case holder 17. A press operating handle 19 is pivotally connected at 20 to the lower end of ram 16 and is pivotally connected at 21 to a link 22 which is pivotally connected at 23 to press body 10. It will be evident that when the manual operating lever 19 is swung in the direction of the arrow 24 while handle 11 is held, ram 16 will move upwardly and drive ammunition case 18 into die 13 for performing one or more of the conditioning operations on the case that are required for reloading the cases.

Figure 2:
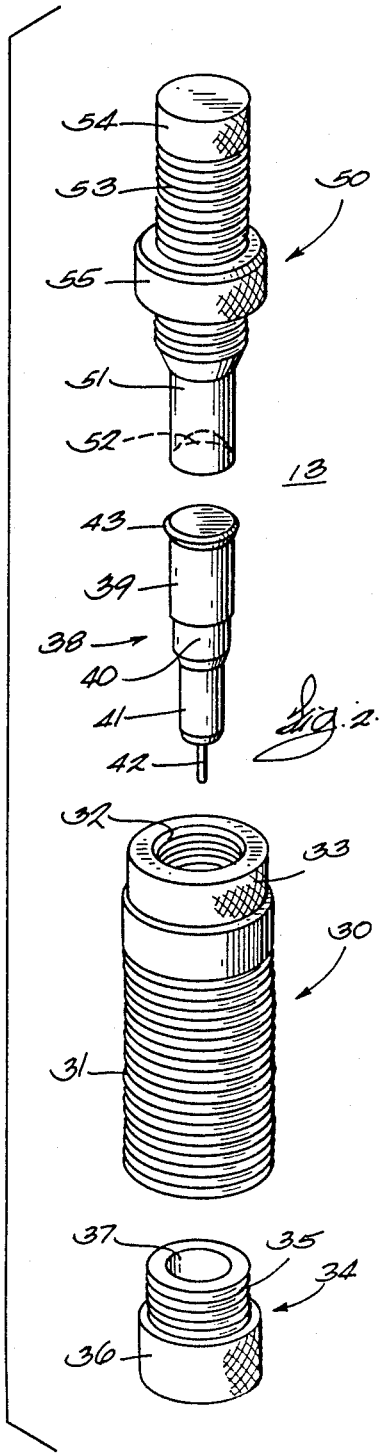
FIG. 2 is an exploded view of the new die.

The parts of the first embodiment of the new die will now be identified in reference to FIG. 2. The die comprises a cylindrical body 30 which has an external thread 31. The pitch and diameter of the thread 31 comply with the standard used for dies throughout the world, that is, the outside diameter of the body and thread is seven-eighths of an inch and the pitch is fourteen threads per inch. The body is open from its first or nominally upper end to its second or nominally lower end and has an internal thread 32 at its upper end. The upper end of body 30 is knurled as at 33 to facilitate screwing the body into head 12 of the press in FIG. 1. A sizer for sizing the outside diameter of ammunition cases is designated generally in FIG. 2 by the numeral 34. The sizer has a male thread 35 and a knurled cylindrical portion 36 which facilitates screwing the thread 35 of the sizer into a mating thread, which is not visible in FIG. 2, in the lower end of the body 30. The sizer 34 has a bore 37, of the proper diameter for sizing the outside diameter of the cases when the cases are pressed through the sizer bore 37. The sizer could be designed with a female thread, not shown, for turning it on the male thread 31 of the body 30.

The die in FIG. 2 further comprises a mandrel which is generally designated by the reference numeral 38. The mandrel has a cylindrical portion 39 which telescopes into a corresponding bore 25, not visible in FIG. 2 but shown in FIG. 3, inside of body 30. The mandrel has a slightly smaller diameter portion 40 next to cylindrical portion 41. The smallest diameter portion 41 which has a decapping or depriming pin 42 in its lower end. As will be evident later, the cylindrical portion 40 of the mandrel corresponds in diameter to the desired inside diameter of the case neck and the cylindrical portion 39, called the expander, provides for slightly flaring or expanding the mouth of the case so it will easily accept a manually placed bullet. The mandrel 38 also has a small shoulder or radially extending flange 43 which prevents it from slipping through the die body 30 as will be elaborated later.

Another part of the die assembly 13 in FIG. 2 is the bullet seater plug which is generally designated by the numeral 50. It is a solid body terminating at its lower end in a cylindrical part 51. The lower tip of cylindrical portion 51 is concave as at 52 and this concavity has a curvature which mates with the concave tip of a bullet that is to be inserted in the case as will be evident later. Most of the length of the bullet seater plug 50 has an external thread 53. Its upper end is knurled as at 54 to facilitate screwing the plug into the internal thread 32 of die body 30. Thread 32 is visible in FIG. 3. The plug has a locking ring 55 turned onto it. The purpose of this ring will be described subsequently.

Further details on the construction of the die and the manner in which it is used will now be discussed in reference to FIGS. 3, 4 and 7.

Figures 3, 4, 5, 6, 7:
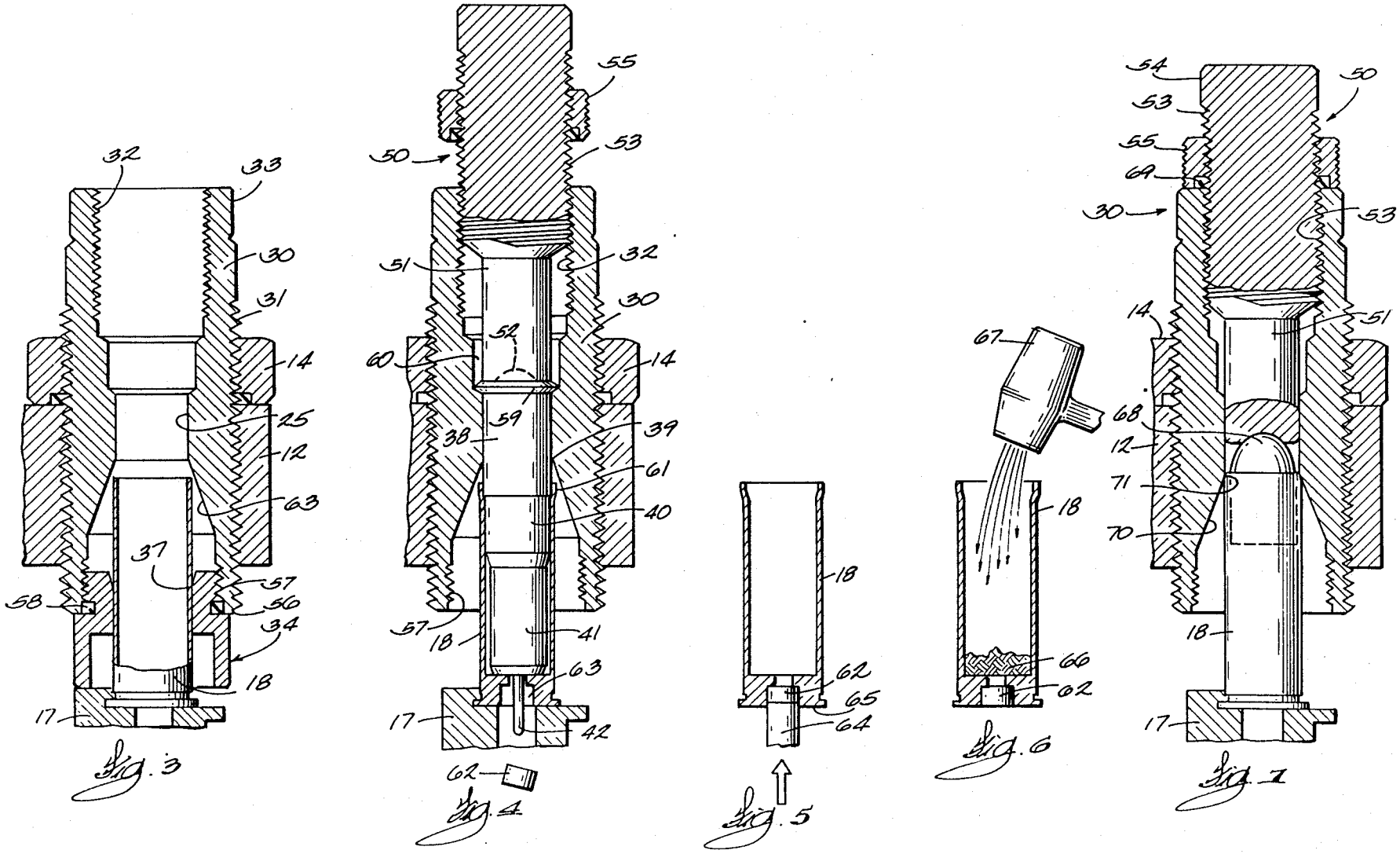
FIG. 3 is a vertical section of the die showing the body of the die screwed into a reloading press and showing the sizer element for sizing the outside diameter of the die screwed onto the die body.
FIG. 4 is a vertical section of the die body which presently contains an element for decapping or driving out the spent primer from an ammunition case while simultaneously sizing the internal diameter of the neck of the case and flaring its mouth, this FIGURE also shows how the decapper and internal sizing element is retained in the die body by means of a bullet seating member.
FIG. 5 is for symbolizing that the ammunition cases have new live primers inserted in them after their inside and outside diameters have been sized by the steps performed in FIGS. 3 and 4.
FIG. 6 illustrates that after new primers are inserted in the cases they are charged with gun powder.
FIG. 7 shows a vertical section of the die body which now has only the bullet seating member inserted in it for performing the last operation in the reloading process, namely, pushing the bullet to the desired depth in the case and crimping the mouth of the case onto the bullet.

FIG. 3 shows the setup for performing the first shaping operation on the ammunition case 18. The case is mounted in a holder 17 which is, as explained earlier, mounted on the end of the press ram 16. The first step is for the user to screw the die body 30 into the press head 12, while the sizer 34 is screwed into the lower end of the die body 30, as far as the sizer will go, that is, until the shoulder 56 on the sizer 34 abuts the lower end of the body 30. As can be seen, the sizer has an external thread 57 which permits it to be screwed into a mating internal thread in the lower end of the body 30. An o-ring 58 imposes some frictional drag to prohibit the easily manually turned in sizer from inadvertently backing out slightly from the die body 30. The bore into which the sizer element is screwed tapers inwardly as indicated by the numeral 63. In FIG. 3, it will be apparent that the ammunition case 18 has passed through the sizing bore 37 of the sizer so that the outside diameter of the case 18 has been accurately established. Sizer 34 is made of hard steel. In another model, discussed later, a liner comprised of an extremely hard substance such as tungsten carbide is set in the sizer and contains the bore 37. The hard steel or tungsten carbide burnishes the cases so they look like they are newly manufactured.

In FIG. 3, it is easy for the user to determine how far the externally threaded body 30 of the die should be turned into reloading press head 12. All the user has to do is bring the ram 17 up to its upper limit and then screw the die body 30 into head 12 until the lower end of the sizer 34 strikes the upwardly held case holder 17. Then, the ram and case holder are backed away and the body is given an additional one half turn. Next the lock nut 14 is tightened against the press head 12 to insure that the position of the body cannot change during performance of the case shaping and bullet installing operations. This automatically sets the die 30 to the correct depth for a bullet seating and case crimping operation which is performed while the bullet is being seated as the last operation in the reloading sequence.

After all of the cases have their outside diameters sized using the setup in FIG. 3, the sizer 34 is unscrewed and separated from the die body 12. Having the sizer separable is the key to being able to perform all other case conditioning operations while the die body stays in its original position. The mandrel 38 is then installed in die body 30 as shown in FIG. 4. The flange 43 at the upper end of the mandrel comes to rest on a shoulder 59 in the bore 60 of the die body. Next, the bullet seating plug 50 is screwed into the die body until the lower end of the plug containing the concave recess 52 meets the top end of mandrel 38. The mandrel is now secured. Knurled locking ring 55 need not be tightened down onto the body 30 at this time. The bullet seating plug 50 holds the mandrel in an exact reproducible position.

As shown in FIG. 4, when a case 18 is pressed into the die, the cylindrical portion 40 of mandrel 38 expands or flares the case mouth and establishes the proper internal diameter of the case for receiving a press fit bullet which is a step performed later in the FIG. 7 setup. Advancing the case 18 far enough for its mouth to slip onto the larger diameter cylinder 39 results in the mouth of the case having a flare 61 which facilitates insertion of a bullet into the case and is shown slightly exaggerated in size in FIG. 4 to make it apparent.

After all of the cases 18 of a batch are sized as in FIG. 3, they are processed in the FIG. 4 setup. When a case 18 is driven into the die under the influence of the ram 16 of the reloading press, the decapping pin 42 strikes the spent primer 62 and drives it out of the primer pocket 63 in the head of the case. Completion of the upward stroke of the reloader ram results in the case being shaped to the proper internal diameter by the cylindrical portion 40 of the mandrel for receiving the bullet and the shoulder or flare 61 is formed on the case by the cylindrical portion 39 of mandrel 38. By way of example, and not limitation, the larger diameter cylindrical portion 39 is typically up to about three thousandths of an inch larger in diameter than the smaller diameter step 40 for a case such as for a 38 special caliber bullet. When the case is retracted from the die, the case mouth 61 contracts slightly so that the inside diameter of the mouth is usually about one thousandth of an inch larger than the bullet that will be inserted in it later.

After all of the cases in a batch are decapped and sized internally in the neck and mouth region with the die setup in FIG. 4, the next two steps in reloading cases, namely, installing a new primer in each case and charging the cases with explosive powder, are now performed. The step of inserting a new primer 62 is symbolized in FIG. 5. Typically, primers are placed on a fixed element 64 and the cases 18 are brought down onto the primer 62 supporting element 64 to press the primer in the head 65 of the case 18. Any suitable primer inserter may be used such as the one shown in U.S. Pat. 4,222,305 which is owned by the applicant in this application.

After all of the cases 18 in a batch are primed, they are charged with gun powder 66 as symbolized in FIG. 6. Usually, the powder is simply poured into the cases 18 from a cup 67. The cup is filled by dipping it into a container occupied by powder and the capacity of the cup is just right for the particular cases being loaded.

The primed and powder charged cases are then successively processed in the new combination die again as depicted in FIG. 7.

In FIG. 7, the die body 30 has remained locked in the same position in reloading press head 12 as in the FIGS. 3 and 4 operations. However, the mandrel 38 is removed in the FIG. 7 setup and the bullet seating plug 50 is screwed into the die body 30. The depth to which the bullet seating plug 50 should be inserted into die body 30 must be determined so the bullet 68 will be pressed in case 18 to the proper depth. The easiest and most accurate way of determining how far the bullet seating plug 50 should be turned in is to start by turning it into the die body 30 an amount that is going to be less than sufficient for pressing the bullet to the proper depth. The objective is to be sure that when the bullet is pushed up on the press ram, it assuredly will not be pressed into the case too far. If, after the first try, it is apparent that the bullet 68 is not pressed deeply enough into the case, the plug 50 can be turned further into the die body 30 and the pressing operation can be repeated. In a few tries or less the adjustment is usually proper. When this condition exists, lock ring 55 is turned down onto the upper end of die body 30. The lock ring 55 is made finger tight. The lock ring will stay at its adjusted position relative to the thread 53 on the plug by reason of the lock ring 55 having an annular channel in which there is an o-ring 69 which creates friction between the lock ring and the plug. This a significant convenience in that the lock ring 55 will maintain its adjustment even when the bullet seater is removed as in FIG. 3 for subsequent batches of cases of the same size.

As shown in FIG. 7, the lower end of the die body 30 has a conical or tapered bore 63. When the case 18 is pressed upwardly to press in the bullet 68, the extremity 71 of the mouth of the case is crimped inwardly slightly t grip the bullet. The place where the extremity 71 of the case becomes wedged against the tapered bore 63 to cause crimping is predetermined when the die body is screwed into press head 12 until the sizer 34 on the die body 30 abuts the case holder 17 as was explained earlier when discussing FIG. 3.

Figures 8, 9, 10, 11:
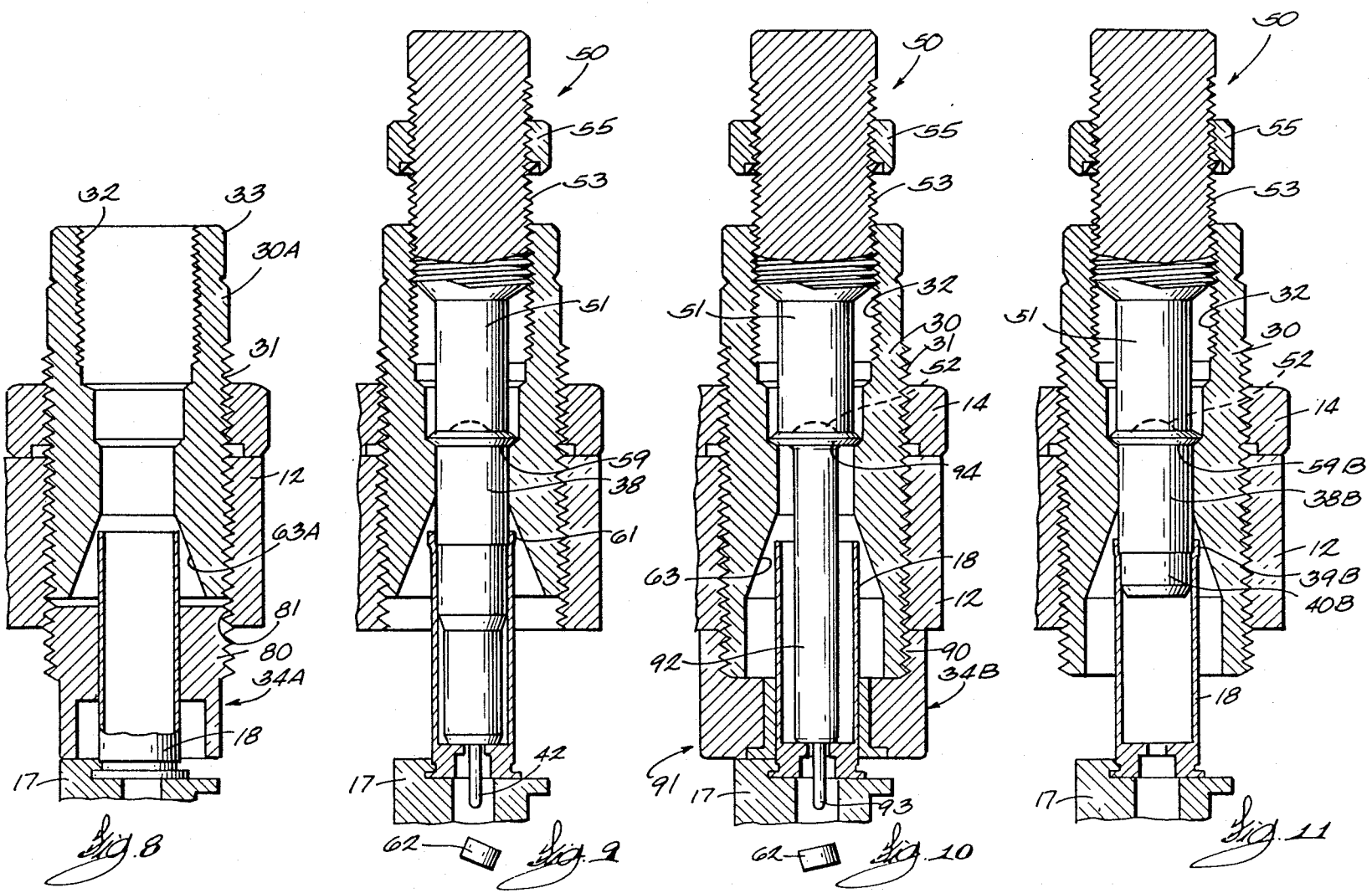
FIG. 8 is a sectional view of an alternative form of die body and resizer element which provides for screwing the resizer element into the reloading press head instead of into the die body as in the previously mentioned embodiment.
FIG. 9 depicts using the die body of FIG. 8 with the resizer element removed and other elements installed for performing concurrent ammunition case flaring and decapping operations.
FIG. 10 is a sectional view of another alternative form of the die body adapted for concurrent decapping and resizing where a modified form of resizer element is used.
FIG. 11 depicts using the die body of FIG. 10 with the resizer element removed and with an element installed for flaring the mouth of an ammunition case.

FIG. 8 depicts an alternative embodiment of the invention. In this figure, parts that are similar to the same parts in FIG. 3 are given the same reference numerals. Parts that are still present but modified are given the same reference numeral except that the numeral has the suffix A added. In FIG. 8, body 30A is reduced in length as will be evident by comparing the internal tapered region 63A with the same region 63 in the FIG. 3 embodiment. In FIG. 8, the case sizer element 34A has an external thread 80 which provides for the sizer element 34A to be screwed into the same thread 81 in the head of the press 12 as the die body 30A is screwed into. This results in the central bore of the sizer element which accommodates the case 18 being coaxial with the die body as was the case in the FIG. 3 embodiment. Thus, in the FIG. 8 embodiment removal of the sizer element 34A from affiliation with the die body 30A is again provided for. In FIG. 8, the sizer element thread 80 is turned into the thread 81 of the die body just a few turns. It is properly adjusted by first screwing it into thread 81 a few turns of head 17 of the press, using handle 19, until the ram is at its uppermost position at the time the shell holder 17 which is mounted on the ram just makes contact with the lower edge of the sizer 34A. Then, the ram is lowered and sizer 34A is unscrewed by about one-half turn. After that, body 30A is screwed into internal thread 81 in the head 12 of the press until the body jams against the top surface of the sizer element 34A. The set up in FIG. 8 is then ready for sizing the outside diameter of the cases 18.

After all the cases 18 in a batch are sized externally, sizer 34A is unscrewed and separated from the die housing 30A and the press head 12 as is the case in FIG. 9.

In FIG. 9, the mandrel 38 has been installed in die body 30A. The externally threaded bullet seating plug 50 with its integral bullet seating cylindrical portion 51 is screwed into the die body 30A as a backup for the mandrel 38. With the set up in FIG. 9, the cases in a batch are successively pressed into the die body 30A under the influence of the ram of the reloading press. As previously explained in reference to FIG. 4, this causes the upper end 61 of the cases 18 to be flared or expanded for accepting a bullet and on the same stroke of the ram, the decapper pin 42 of the mandrel drives the spent primer or cap 62 out of the case 18.

After all of the cases are expanded and decapped, they are recapped as in FIG. 5 and charged with powder as in FIG. 6. The next step is to remove the mandrel 38 in FIG. 9 from the die body 30A and then screw the bullet seating plug 50 into the die body 30A to the proper depth for seating bullets 68 in a manner comparable to the bullet seating operation which was discussed in connection with FIG. 7.

Another embodiment of the new die which takes advantage of the case sizer being separable from the die body, is depicted in FIGS. 10 and 11. In these figures, parts which are similar to parts in FIGS. 3 and 4 are given the same reference numerals.

In FIG. 10, the die body 30 is screwed into head 12 of a reloading press and stays there during the case conditioning steps of the case reloading procedure. In this embodiment, the case sizer element is given the reference numeral 34B to indicate that it differs slightly from sizer element 34 in FIG. 3. Sizer 34B differs in that it has an internal thread 90 which screws onto the thread 31 which extends over most of the length of the die body 30. Sizer element 34B has a tungsten carbide liner 91 which is well known to have the capability of imparting a high polish to the outside of the case when it is forced through the sizer. In the FIG. 10 embodiment, the die is set up for concurrently sizing the outside of cases and decapping cases with a single stroke of the press ram. The decapper comprises a stem 92 which terminates in a decapper pin 93. The decapper has a shoulder 94 which prohibits it from dropping through the die body when the decapper is inserted from the top of the die body. The decapper is backed up by the cylindrical part 51 of the bullet seating plug. As in previously discussed embodiment, the plug is screwed into the internal thread 32 of the die body. As in the FIGS. 3 and 4 embodiment, an ammunition case 18 is carried on the case holder 17 and forced through the central opening in the tungsten carbide liner within sizer 34B. As in previously discussed embodiments, the bore in the lower end of the die body has a tapered portion 63 which the case does not touch when it is forced into the die for sizing and decapping. The taper 63 is used later for crimping the bullet in the case.

When all of the cases of a batch are sized and decapped, the sizer 34B is unscrewed from the external thread 31 of the die body 30. The bullet seater plug 50 is then removed from FIG. 10 and decapper 92 is removed from the die body. Next the expander 38B is inserted in die body 30 and bullet seater plug 50 is restored to provide the setup shown in FIG. 11. In this figure, the die body 30 remains screwed into the reloading press head 12 just as it is in FIG. 10. In FIG. 10 the bullet seater plug 50 and decapper 92 functioned together. In the FIG. 11 arrangement, the bullet seater plug 50 and a modified expander or flarer 38B work together. In FIG. 11, the expander has a small diameter portion 40B and a larger diameter portion 39B. The expander 38B is a separate piece from bullet seater plug portion 51. The expander and bullet seater interface at the shoulder 59B which is formed on the top of the expander.

If one compares the FIG. 11 arrangement with FIG. 4, one may see that the expander 38 in FIG. 4 also carries the decapping pin 42 whereas in the FIGS. 10 and 11 arrangement, decapping is performed in FIG. 10 in conjunction with sizing the cases and only flaring or expanding the mouth of the cases 18 is performed in the FIG. 11 set up.

After all of the cases in a batch have their mouths expanded by the set up in FIG. 11, they are reprimed or recapped as in FIG. 5 and charged with powder. Before or after those steps, the expander 38B is removed from the die body 30 and the bullet reseater 50 is screwed in to the body as in FIG. 7 following steps previously mentioned in connection with discussing FIGS. 3–7. In the FIG. 7 set up, of course, the die body 30 remains fixed where it was in the FIG. 10 and 11 set ups and the sizer 18 is still removed. After a bullet is pressed into each of the cases in a batch and crimped, the resizer element can be turned back onto the external thread 31 of the die body for storage.

Figure 12:
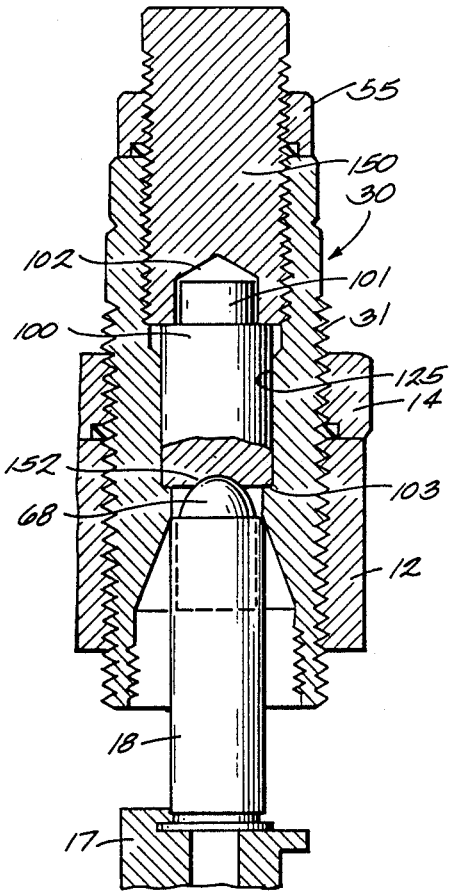
FIG. 12 shows a die body similar to the die body of FIG. 1 in which there is a combination element that is used first for flaring or expanding the mouth of a case and is subsequently inverted and used for seating a bullet in the case.

FIG. 12 shows an embodiment of the invention wherein the die body 30C is externally similar to the die body 30 in FIGS. 3, 4 and 7. Parts that are the same in FIG. 12 as in the earlier figures will be given the same reference numerals. Thus, die body 30C has an external thread 31 which allows it to be screwed into the press head 12 as depicted in FIG. 12. Lock nut 14 secures the die body fixedly in the head 12 for all case reconditioning steps connected with reloading a batch of cases. In FIG. 12, the bullet seater and expander are formed as a single piece. Thus, the bullet seater part of the piece is a cylindrical part 100 which has a concave recess 152 in its lower end for pressing a bullet 68 into an ammunition case 18. An expander part 101 is formed on cylindrical part 100. A modified threaded plug 150 retains the combination seater 100, expander 101 element in the die body 30C. Plug 150 has an axial bore 102 in its end to allow expander 101 to nest in it. As compared with previous embodiments of the die housing 30C, there is an enlarged bore 125 for accommodating the cylindrical part 100 of the bullet seater. As a result of this, a shoulder 103 is formed on the bore which prevents the combination seater 100 and expander 101 from falling through the die body.

The FIG. 12 arrangement can be used in conjunction with an arrangement similar to FIG. 10 but not identical. That is, as a first operation in a reloading step, the resizer 91 in FIG. 10 could be screwed onto the die body of FIG. 12 and the decapper 92 would be inserted in the die body prior to insertion of the combination seater 100 and expander 101 of the FIG. 12 arrangement. These elements would be held in place with the threaded plug 150 depicted in FIG. 12. After all the cases in a batch are decapped and sized, the sizer 91 would again be removed and the combination element of FIG. 12 would be inverted so that the expander part 101 would be pointed downwardly with the threaded plug 150 holding it in place. Then all of the cases in the batch have their mouths slightly expanded by pressing the cases into the die body until the expander 101 enters the case mouth by a small amount. Then, when the cases are recapped or reprimed and charged with powder, the combination bullet seater 100 and expander 101 would be restored to the position in which the combination element is depicted in FIG. 12. After the plug 150 is screwed into the die body 30C to back up the combination element, the device would be ready for pressing bullets into the cases as depicted in FIG. 12.

Although embodiments of the invention have been described in detail, such description is intended to be illustrative, rather than limiting, for the invention may be variously embodied and is to be limited only by interpretation of the claims which follow.

I claim:

1. A multifunctional ammunition case reloading die assembly adapted for being mounted to the die holder of an ammunition reloading apparatus, comprising:

an elongated generally cylindrical die body having first and second ends, a bore extending from end to end, and an external thread for mounting to said die holder, a case sizer element and means for uncoupling said sizer element to and from, respectively, said second end of the die body, said element having a hole disposed coaxial with said bore into which hole an ammunition case is pressed to size it and from which said case is withdrawn while said sizer element remains coupled to said die body, said die body being adapted to remain mounted in said holder for performing at least one other reloading operation after said sizer element is uncoupled from the holder.

2. The die assembly according to claim 1 wherein said second end of said die body has an internal thread and said sizer has an external thread to facilitate coupling and uncoupling said sizer to and from said body.

3. The die assembly according to claim 1 wherein said second end of said die body has an external thread and said sizer has an internal thread to facilitate coupling and uncoupling said sizer to and from said body.

4. The die assembly according to any one of claims 1, 2 or 3 in combination with a reloading press constituting said ammunition case reloading apparatus, said press including a ram forcibly reciprocating between lower and upper limits and an ammunition case holder mounted to an end of the ram, said die body being screwed into said die holder of said press to only sufficiently for said sizer element to make contact with said case holder when said ram and the die holder thereon are at said upper limit.

5. The die assembly according to claim 1 wherein:

said die body has an internal thread in said bore proximate to said first end of the die body, a combination case mouth expanding and decapping mandrel for being inserted in said bore from the first end of the die body when said sizer element is uncoupled from the die body, said mandrel being comprised of axially adjacent cylindrical portions and having one end facing toward said first end of the die body and an opposite end proximate to said second end of the die body, the end of the mandrel proximate to the second end of the die body having a projection for decapping ammunition cases which are pressed onto said mandrel, the cylindrical portion of the mandrel at said one end having a slightly larger diameter than the adjacent cylindrical portion such that when said case is forced onto said mandrel the mouth of the case is expanded by said larger diameter portion, and a bullet seating plug including a portion having an external thread for being screwed into said internal thread of the die body and having an end for bearing against said one end of the mandrel to hold said mandrel while cases are being pressed onto it, removal of said bullet seating plug from said die body allowing said mandrel to be removed and replacement of said bullet seater plug in said die body disposing said end of the plug in a position to press a bullet in a case when a case with a bullet set on it is pressed against said end of the plug.

6. The reloading die according to claim 1 wherein said die body is screwed into said die holder with said case sizer element coupled to said body until said sizer element contacts a case holder on said reloading device when said case holder is driven by said reloading device to the limit of the travel of said case holder toward said sizer element, before sizing of cases is begun, and a lock nut threaded on said external thread of the die body for being tightened against said body to hold said body in the exact same position in said die holder for sizing said cases and for expanding, decapping and seating bullets in said cases.

7. The reloading die according to claim 5 including a locking ring element threadingly turnable on said threaded portion of the bullet seating plug until one end of said ring interfaces with said die body for locking said plug to said body, said locking ring having an annular channel in said end that interfaces with said body for surrounding the thread on the plug, and an o-ring in said channel for developing friction that maintains said locking ring in a fixed position on said plug when said plug is screwed out of said die body.

8. The reloading die according to claim 1 wherein said bore in said die has an annular tapered portion against which the mouth of said case is pressed when said case is pressed far enough into said die body to properly seat a bullet such that the rim of the mouth is crimped on said bullet.

9. The die assembly according to claim 1 wherein:

said die body has an internal thread in said bore proximate to said first end of the die body, a decapper element insertable in said bore from said first end of the die body and having a pin disposed proximate to said sizer element for decapping said case when it is pressed through said hole in the sizer element to size the case, a bullet seating plug including a portion having an external thread for being screwed into said internal thread of the die body and having an end for bearing against said decapper element to hold it in place while said case is being sized and decapped, an expander element for being inserted in said bore of the die body when said sizer, decapper element and bullet seating plug are removed from the die body, said expander element being cylindrical for the case to be pressed onto it for expanding the mouth of the case while said bullet seating plug is restored to said die body for holding said expander element in place, removal of said bullet seating plug providing for removal of said expander element from said die body and restoring said bullet seating plug to said body causing said end of the plug to be presented at said second end of the die body for pressing a bullet in said case.

10. The die assembly according to claim 1 wherein:

said die body has an internal thread in said bore proximate to said first end of the die body, a plug having an external thread for being screwed into said internal thread while said sizer is uncoupled from the die body, a combination case expanding and bullet setting element insertable in said bore from said first end of the die body, said element being generally cylindrical and having one end adapted for setting a bullet in said case when the case with a bullet set in it is pressed against said one end and said element having a cylindrical expander opposite said one end for expanding the mouth of said case, said combination case expanding and bullet seating element being used first in the case conditioning process with said cylindrical expander being presented toward said second end of the die body for expanding the mouth of said case when a case is pressed on said expander and said plug is holding said element in place, said plug being removed to provide for inverting said element and said plug being replaced to hold said element with its said one end presented toward said second end of said die body for pressing a bullet in said case.

* * * * *

UNITED STATES PATENT AND TRADEMARK OFFICE

CERTIFICATE OF CORRECTION

PATENT NO. : 4,836,078

DATED : June 6, 1989

INVENTOR(S) : Richard J. Lee

It is certified that error appears in the above—identified patent and that said Letters Patent is hereby corrected as shown below:

Column 9, Line 67 (Claim 1):

After "for" insert --- coupling and ---

Column 10, Line 24 (Claim 4):

After "press" delete "to"

Signed and Sealed this

Nineteenth Day of June, 1990

*Attest:*

HARRY F. MANBECK, JR.

*Attesting Officer*

*Commissioner of Patents and Trademarks*